US005823730A

United States Patent [19]

La Rovere

[11] Patent Number: 5,823,730

[45] Date of Patent: Oct. 20, 1998

[54] CAN WITH EASY OPEN END AND PROTECTION AGAINST CUTS

[75] Inventor: Ruggiero La Rovere, Rio de Janeiro, Brazil

[73] Assignee: Rheem Empreendimentos Industriais e Comerciais S/A, Rio de Janeiro, Brazil

[21] Appl. No.: 619,311

[22] Filed: Mar. 21, 1996

[30] Foreign Application Priority Data

Mar. 21, 1995 [BR] Brazil ..... 9500961-2

[51] Int. Cl.[6] ..... B21D 51/44

[52] U.S. Cl. ..... 413/12; 413/13; 72/348; 72/350

[58] Field of Search ..... 413/12, 13, 14, 413/15, 16, 17, 66, 67; 72/348, 350

[56] References Cited

U.S. PATENT DOCUMENTS

| | | | |
|---|---|---|---|
| 3,705,563 | 12/1972 | Elser | 413/17 |
| 3,857,166 | 12/1974 | Gaillard | 29/509 |
| 3,868,919 | 3/1975 | Schrecker | 413/17 |
| 3,939,787 | 2/1976 | Morrison | 113/121 |
| 3,990,376 | 11/1976 | Schubert | 413/17 |
| 4,386,713 | 6/1983 | Baumeyer | 220/269 |

*Primary Examiner*—Jack W. Lavinder

*Attorney, Agent, or Firm*—Birch, Stewart, Kolasch & Birch, LLP

[57] ABSTRACT

A can of the type having a cylindrical body, has an easy open end seamed on it. The easy open end includes a center panel defined by a scored ring. The scored ring lies under an S-shaped bend formed around a perimeter of the center panel. A process for forming the easy open end includes the steps of: forming a semi-toroidal protuberance on the easy open end; coining a scored ring close to an external edge of the protuberance; and deforming the protuberance through a radial compression and a compression transverse to the radial compression to form the S-shaped bend with three thicknesses of material.

5 Claims, 9 Drawing Sheets

CAN WITH EASY OPEN END AND PROTECTION AGAINST CUTS

BACKGROUND OF THE INVENTION

1. Field of the Invention

The present invention refers to a can of the easy open top type including a protection against cuts and a process for producing said top with a protection against cuts. The invention further includes a process for forming a protection bend on an easy open end.

2. Description of the Relevant Art

Cans known in the state of the art and provided with a so-called easy open end are cans in which the top is removed without the help of can openers and the like, by extracting a center piece provided with a grip and externally connected to the can end by a scored ring or a circular weakening line which gets ruptured at the moment of opening the can. Examples of documents describing such an end structure are, for example U.S. Pat. Nos. 4,848,623, 3,715,052 and 3,477,608, as well as applications PCT/US87/02649, PCT/US87/03418 and PCT/US88/02475.

The edges of the center panel after extraction are similar to sharp knives, liable to cause serious deep cuts if not handled with caution. In an attempt to dissolve the present inconvenience, the Brazilian patent application PI 9202776 of the present inventor foresees a wavy shape of the center panel's edge at the area adjacent to the cut. However, even through this wavy shape reduces the possibility of deep cuts, it may still cause lighter cuts due to the possibility of the cutout edge contacting a user's skin.

The U.S. Pat. No. 4,848,623, in the name of Saunders, as swell as the application PCT/US88/02475 constitute attempts to solve this problem with a completely new design. The new design includes a circumferential bend which protects the cutting edge preventing it from contacting the skin or fingers of the user. These documents also describes a process to bend the edge of the top center piece in order to avoid the cutting edge and also another bend on the remaining part of the end attached to the can body, which also has a cutting edge capable of hurting the user. However, these processes present the inconvenience of high cost due to the increase in sheet area required for each end.

The Brazilian patent application PI 9402301 of the present inventor refers to a drop shaped projection formed from the side surface of a can, which prevents contact of the user with the cutting edge formed at the outer rim of the can, but does not foresee a solution for the cutting edge in the center panel after its removal.

SUMMARY OF THE INVENTION

Thus, the objective of the present invention is to provide protection to easy open ends to avoid the danger represented by the external cutting edge of the center panel after its removal.

Another objective of the present invention is to provide a process for forming an easy open end with a protection bend.

Another objective of the present invention is to provide a process for forming a protection bend in an easy open end.

Such objectives are achieved by the present invention which includes an easy open end in which the center panel is formed with an S-shaped bend, which follows closely the external edge of said center panel and in particular this bend being laid over said edge and projecting radially beyond said edge.

The S-shaped bend is laid out on the cutting edge. After removal of the center panel of the end, said bend is projected beyond the cutting edge. This causes the cutting edge to be positioned closer to the center (radially) and thus makes it impossible to directly touch the cutting edge with the user's hands. In other words, due to the fact that the bend is projecting beyond the original cutting edge, it will act as a new non-cutting edge.

In order to form this bend, the present invention foresees a process for forming an easy open container lid comprising the steps of forming a container lid blank, forming a continuous, semi-toroidal protuberance near a perimeter of the lid blank, coining a scored ring between the continuous, semi-toroidal protuberance and the perimeter, and adjacent an edge of the continuous, semi-toroidal protuberance and deforming the continuous, semi-toroidal protuberance using a deforming force having a first component force directed toward the perimeter and a second component force directed transversely to the direction of the first component force, wherein the continuous, semi-toroidal protuberance is shaped into an s-shaped bend.

The present invention includes furthermore a process for forming an easy open container lid comprising the steps of forming a container lid blank, forming a continuous, semi-toroidal protuberance near a perimeter of the lid blank, forming a bubble on the lid blank, coining a continuous, first scored ring between the continuous, semi-toroidal protuberance and the perimeter, and adjacent an edge of the continuous, semi-toroidal protuberance, coining a discontinuous, second scored ring adjacent the bubble, deforming the continuous, semi-toroidal protuberance using a deforming force having a first component force directed toward the perimeter and a second component force directed transversely to the direction of the first component force, wherein the continuous, semi-toroidal protuberance is shaped into an s-shaped bend, forming at least one reinforcement bend in the lid blank adjacent the bubble, and riveting a lever to the lid blank at the bubble.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
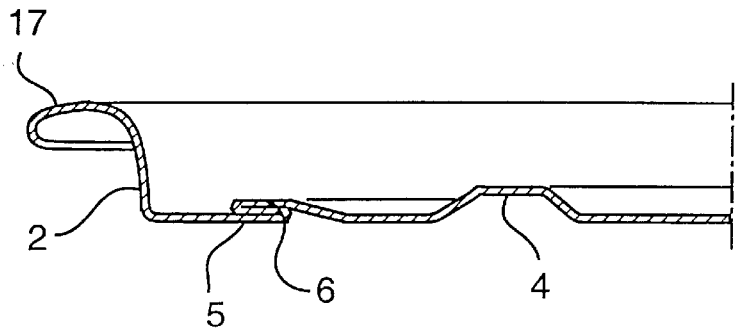
FIG. 1 is a cross sectional view through a central axis of an easy open top according to the present invention.

With regard to the attached Figures, 1 indicates generically a can body provided with an easy open end 2 fixed to the can by means of seaming 3. Said end 2 includes a center panel 4 which can be detached from the scored ring 5.

Said scored ring 5 is protected by an S-shaped bend 6 laid out on said scored ring 5. The S-shaped bend 6 includes a first flat portion 7 starting from the center panel 4, a first 180° curve 8, a second flat portion 9 starting from the first curve 8 and extending in the direction of the center of end 2 to a second 180° curve 10 which leads to a third flat portion 11 extending radially outwards from the end 2 and containing the scored ring 5. The structure described above has the scored ring 5 below the first curve 8.

Figure 2:
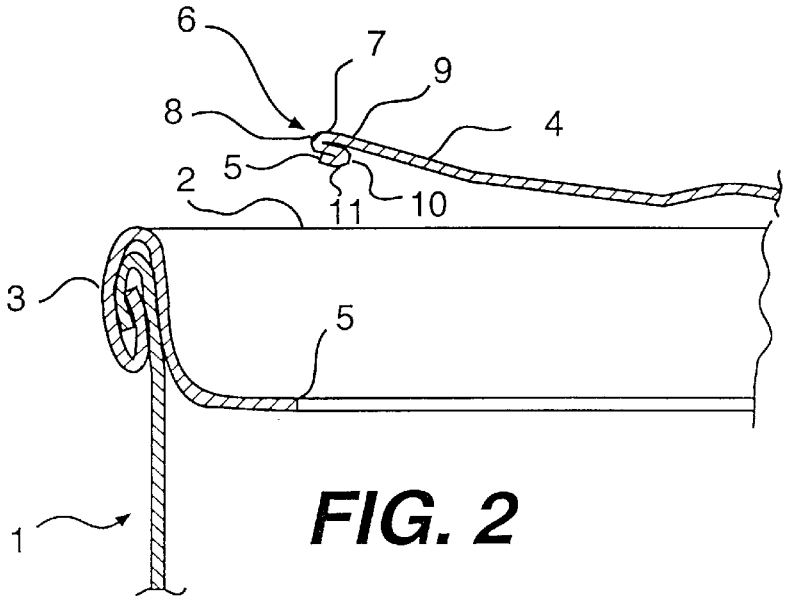
FIG. 2 is a view, similar to FIG. 1, with the easy open top dislocated due to the opening and rupture of the scored ring.
Figure 3:
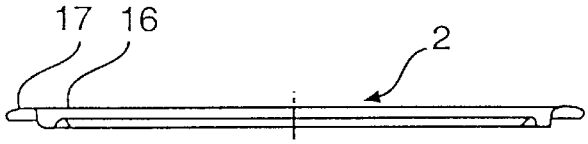
FIG. 3 is a cross sectional view of the lid blank provided with a toroidal protuberance.
Figure 3A:
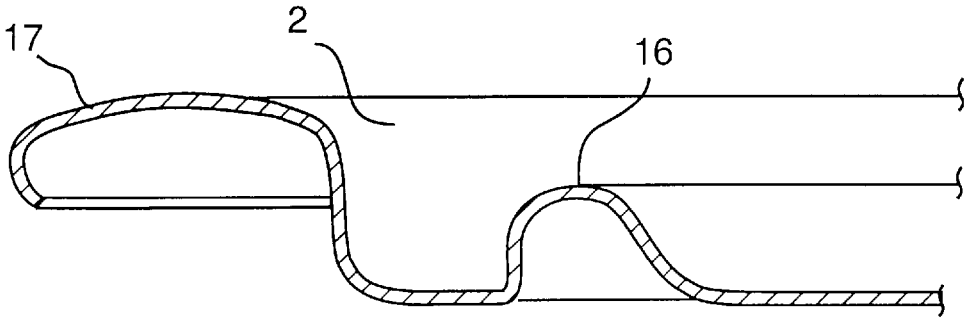
FIG. 3A is a magnified view of the toroidal protuberance of FIG. 3.

After detaching the center panel 4 from the end 2 (see FIG. 2), the cutting edge formed by the rupture of the scored ring 5 will be fully protected from external contact with hands, since the case of accidental touch by the user, he will only touch the externally projecting part of the first curve 8 and never touch the cutting edge formed by ruptured scored ring 5. The protection occurs even if the user, not only touches said edge, but firmly grips the detached center panel 4.

For forming said S-shaped bend 6 (see FIGS. 3 through 7), the present invention includes a process comprising basically the steps of:

a) forming on the easy open end 2 a semi-toroidal protuberance 16, a section of this protuberance 16 being preferentially semi-circular;

b) coining the scored ring 5 as close as possible to the external edge of the toroidal protuberance 16; and c) deforming the protuberance 16 by means of a radial compression and a compression transverse to the radial compression, thus forming the S-shaped bend 6 with three thicknesses of material.

Figure 4:
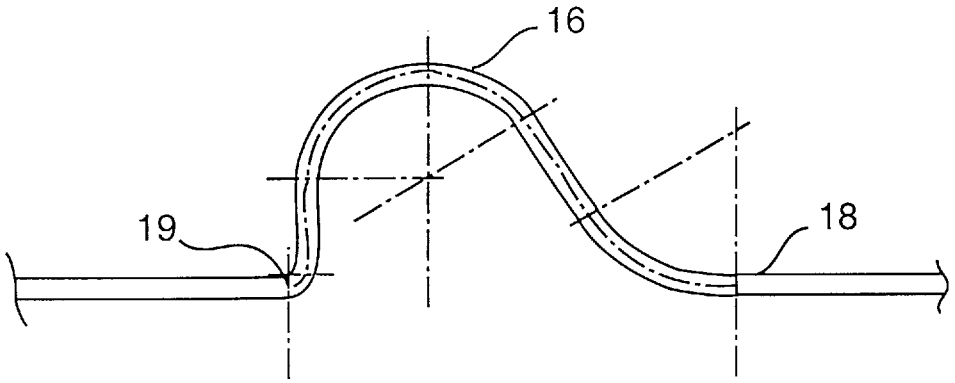
FIGS. 4 and 4A show the toroidal protuberance before and after forming the S-shaped bend.
Figure 4A:
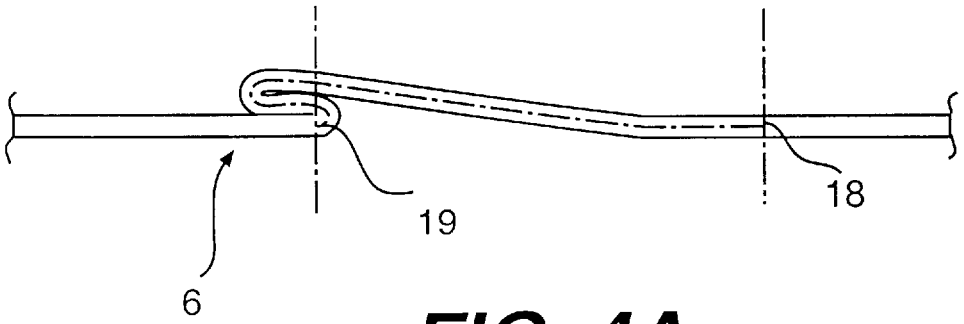

More specifically, starting with the end 2, i.e., an end without any structures beside the material seaming rim 17, a protuberance 16 is formed, which in cross section preferentially presents a semi-circular shape. According to FIGS. 4 and 4A, said protuberance 16 is shaped in such a way that the length of the median fiber of the material thus shaped is equal to the length of the median fiber of the material subsequently formed at the S-shaped bend 6. In other words, the distance between the initial point 18 and the final point 19 of the protuberance 16 is kept unchanged with the forming of the S-shaped bend 16, i.e. the material forming the protuberance does not suffer any compression or expansion stress in the radial direction during the forming of the S-shaped bend 6. Said protuberance 16 maintains a constant thickness (E) and a curvature radius (R) during the operation performed on the end 2.

Figure 5:
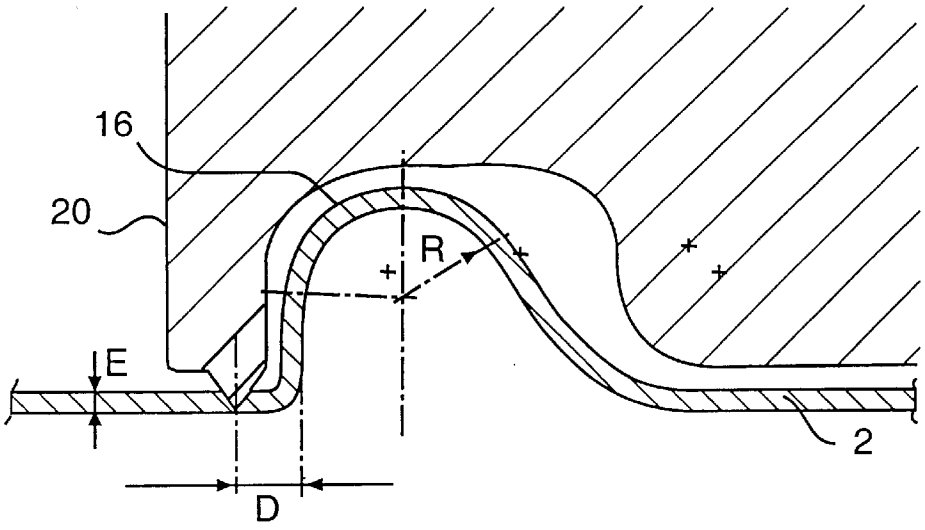
FIG. 5 is a cross sectional view illustrating a coining die forming the scored ring.

Relative to step b) of the present process, FIG. 5 illustrates the moment at which a scoring die 20 is forming the scored ring 5. The distance (D) from the internal part of the protuberance 16 to the central point of the scored ring 5 is as small as possible. Such a condition is imperative for the success of the present process. Having a large distance (D) would create the need of increasing the size of the flat portions 7, 9 and 11 of the S-shaped bend 6 and thus would increase the material required for the end 2.

Figure 6:
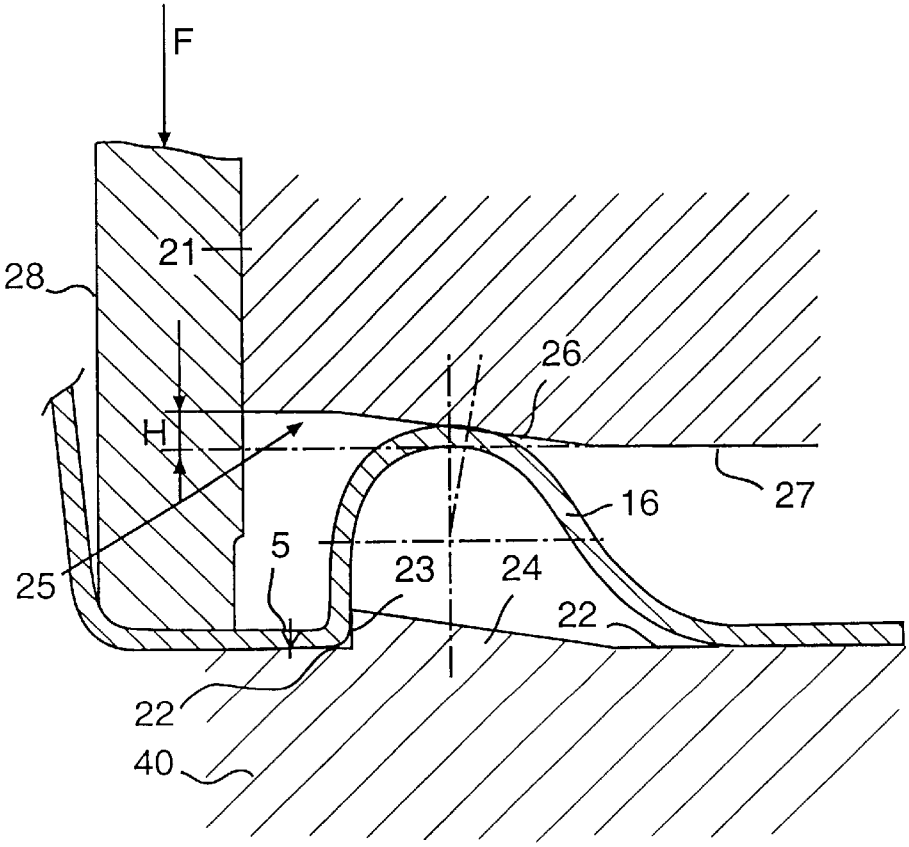
FIG. 6 is a cross sectional view illustrating compression of the toroidal protuberance by an S-shaped bend forming die.
Figure 7:
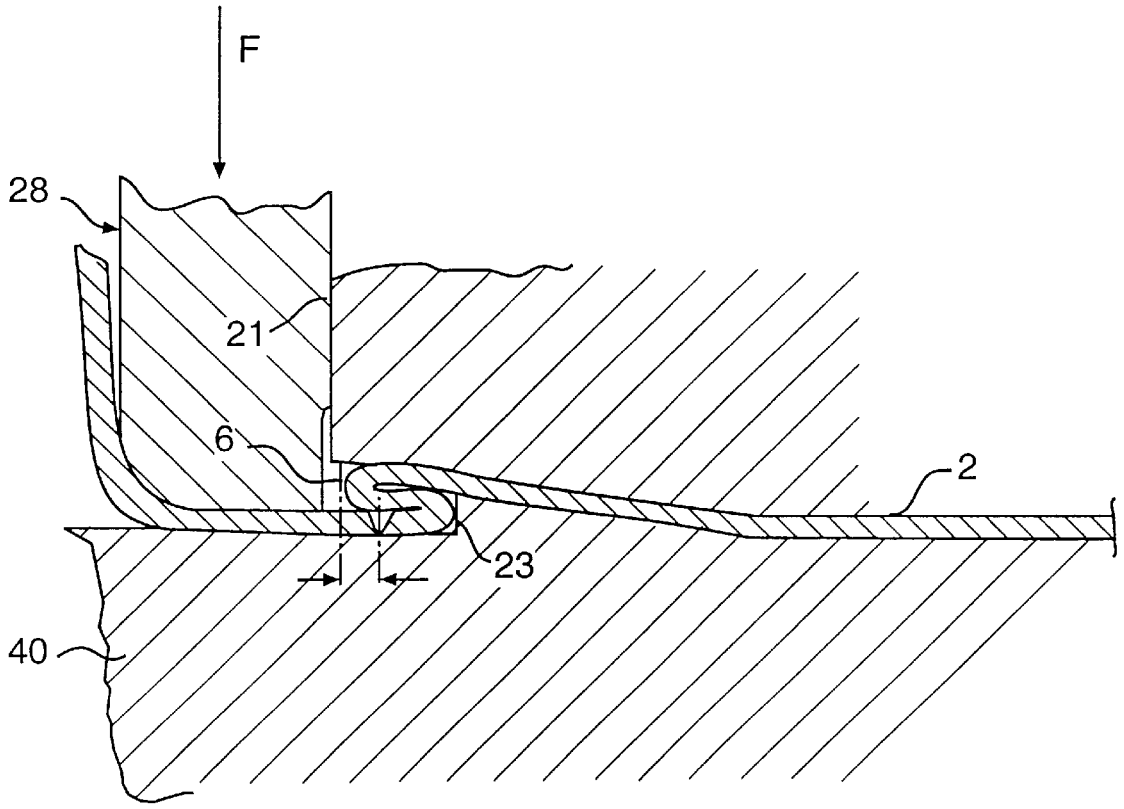
FIG. 7 is a cross sectional view of the S-shaped bend forming dies with the S-shaped bend in the final stage.
Figure 8A:
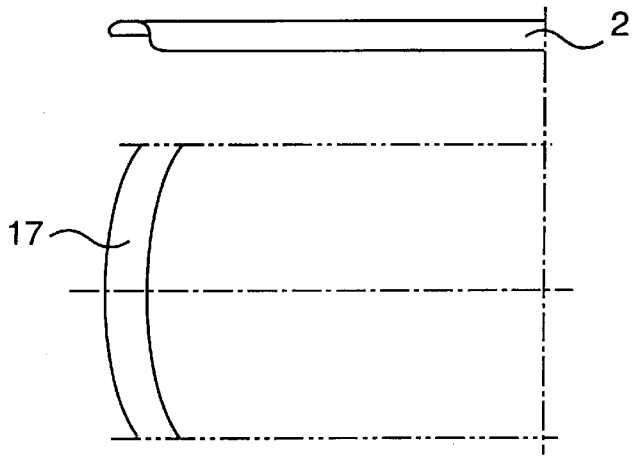
FIGS. 8A through 8K show in schematic form the sequence of forming the easy open top of the present invention.
Figure 8B:
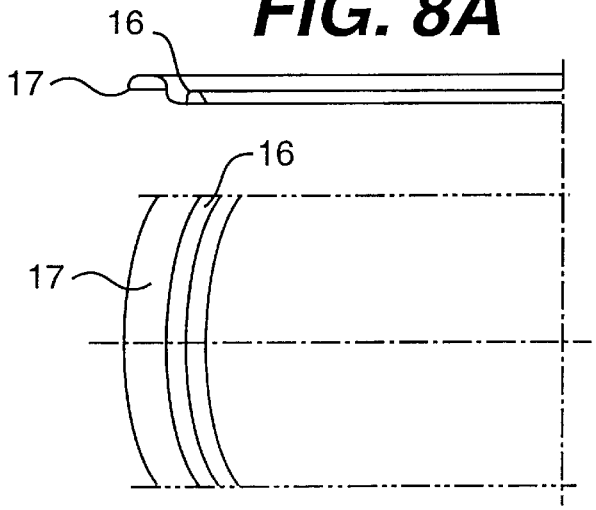
Figure 8C:
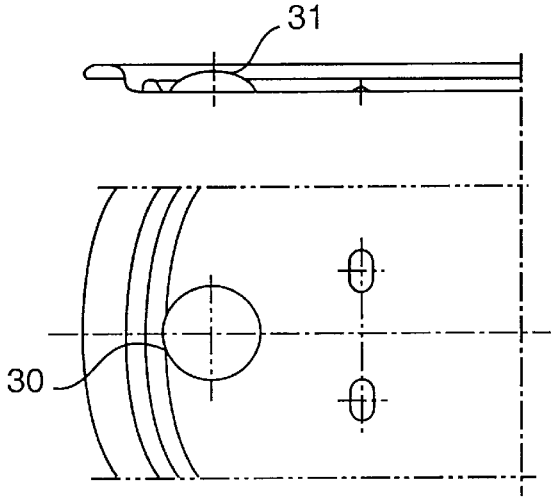
Figure 8D:
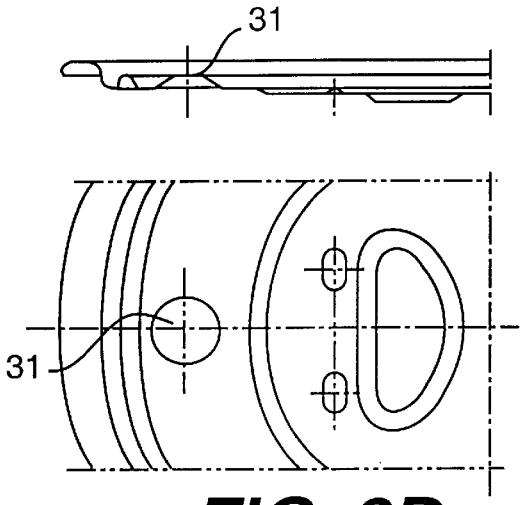
Figure 8E:
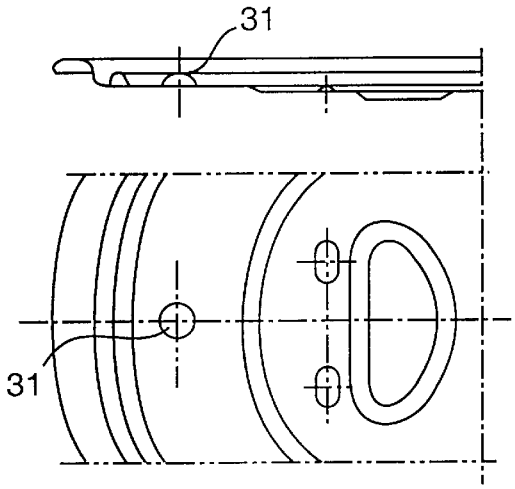
Figure 8F:
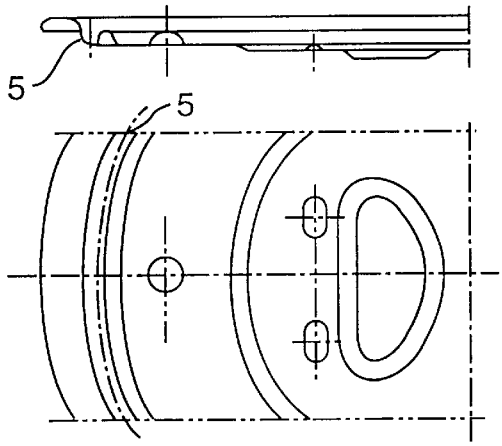
Figure 8G:
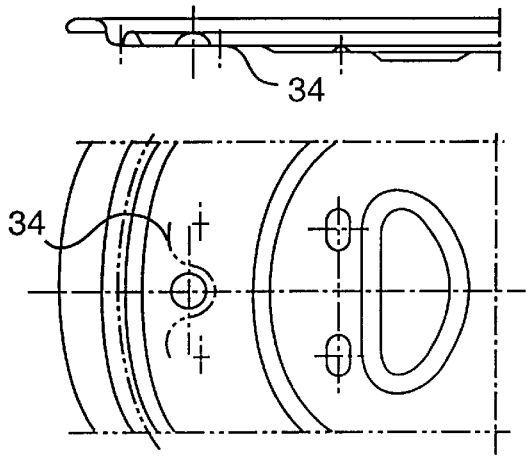
Figure 8H:
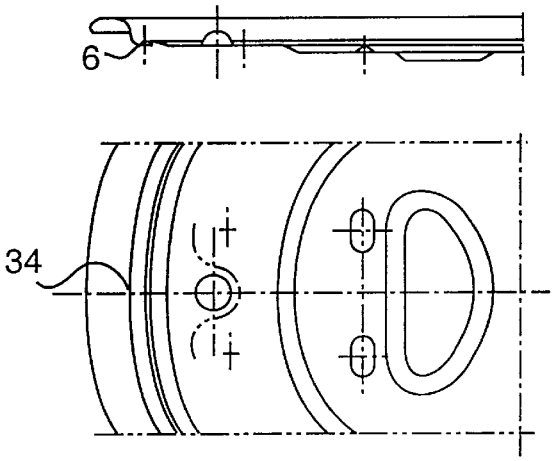
Figure 8I:
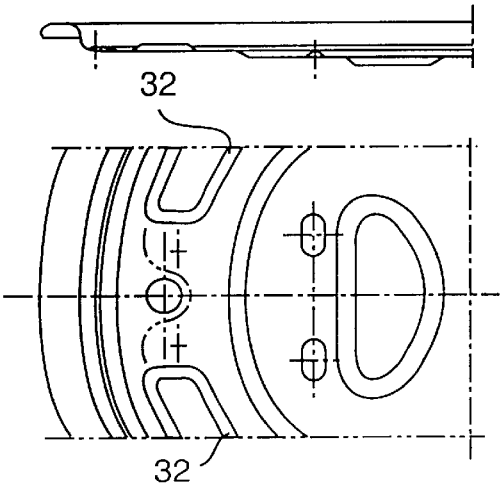
Figure 8J:
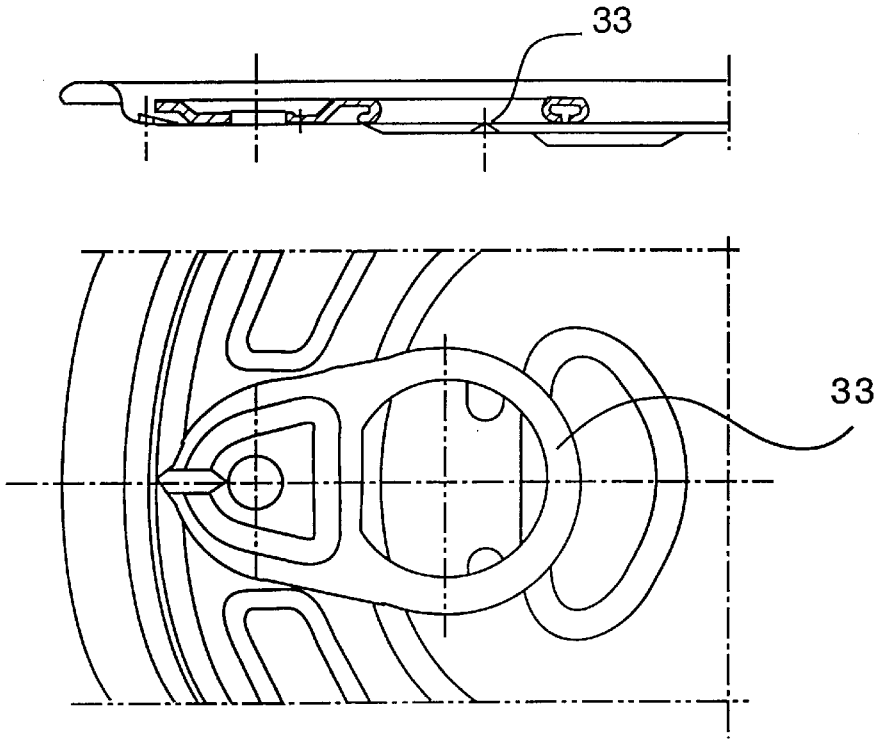
Figure 8K:
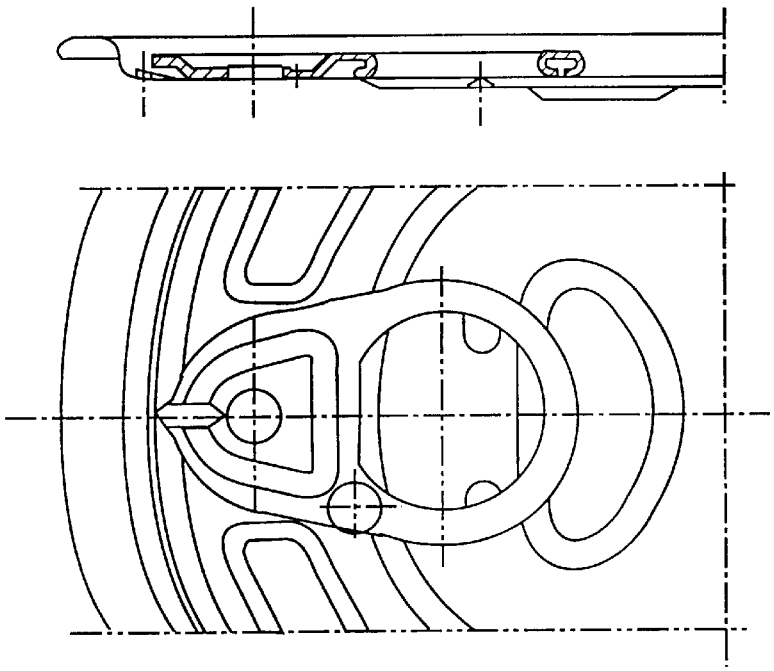

The third step c) of the present process includes the compression of said protuberance 16 to form the S-shaped bend 6 as illustrated by FIGS. 6 and 7. For the performance of this step c), a circular forming die is used consisting of a lower part 40 and an upper part 21. Said lower part 40 is formed by a plane surface 22 from which a pressing surface 23 is projected perpendicularly to same and which returns to the original level by means of a conical surface 24.

The upper part 21 of said die is composed of a first flat surface 25 which is connected to a conical surface 26 extending to a second flat surface 27. The connection of the first flat surface 25 to the conical surface 26 corresponds to the pressing surface 23 of the lower part 40. The conical surface 26 of the upper part 21 corresponds to the conical surface 24 of the lower part 40 both in inclination and length. Furthermore, the distance (H) between surfaces 25 and 27 corresponds to a maximum of twice the thickness (E) of the material composing the end 2 and thus, at maximum to the sum of the flat portions 7 and 9 of the S-shaped bend 6.

Additionally, a hold down ring 28 is placed on the outside of the cylindrical surface of the upper part 21 and connected thereto by means of springs or other resilient means. The hold down ring 28 may be dislocated independently from the movement of the upper part 21 by a stroke exceeding the height of the protuberance 16, in order to ensure that the lower portion of said hold down ring 28 touches the end 2 being shaped before the upper part 21 starts compressing the protuberance 16.

During the forming operation, the end 2 is placed on the lower part 40 of the circularly forming die so that the internal part of the protuberance 16 rests against the pressing surface 23. Next, the upper part 21 starts its downward movement causing contact of the hold-down ring 28 with the end 2 and applying a vertical force F, preventing movement or deformation of the external part of end 2. Then, continuing the downward movement of the upper part 21, (see FIG. 6), the conical surface applies on the protuberance 16 a vertical downward force and a radial component in an outward direction relative to the center of the end 2. The composition of these two forces added to the action of the vertical surface 23 form the S-shaped bend 6 as illustrated in FIG. 7. The distance (H) between the surface 25 and 27 ensures tightening of the S-shaped bend 6 and thus, as already anticipated, said distance is less than or equal to twice the thickness (E) of the material composing the bends.

In summary, the present invention includes a manufacturing process for an easy open end 2 for a can 1 including the steps of:

A) forming the end 2;

B) forming a toroidal protuberance 16;

C) forming a bubble 30 for a rivet 31;

D) first staking of the rivet 31;

E) second staking of the rivet 31;

F) coining the scored ring 5;

G) coining a mustache-shaped scored ring 34;

H) forming of the S-shaped bend 6;

I) forming of a horseshoe type reinforcement 32;

J) riveting an opening lever 33; and

K) inspection.

The forming of the toroidal protuberance 16 (step B) can be performed in a conversion press downstream from the forming operation forming the end 2. However, and preferentially, steps A and B are simultaneously performed at the press forming the end 2. The remaining steps from C to K are preferentially performed on a multiple press. There may be some inversion in the order of performing the above steps, as well as the simultaneous performance of some steps (two on the same press station).

Thus, the process described above is a preferred form of adapting the process of forming an S-shaped bend 6 to the conventional process of manufacturing an easy open end. Preferentially, the step of forming the S-shaped bend 6 shall be performed prior to riveting the opening lever 33; and the step of forming the toroidal protuberance 16 shall be performed on the press which forms the end 2.

The present invention combines perfectly with the patent application PI 9202776, this resulting in a protection both for the cutting edge formed on the center panel after its removal, as well as for the internal edge of the end remaining attached to the can.

Figure 9:
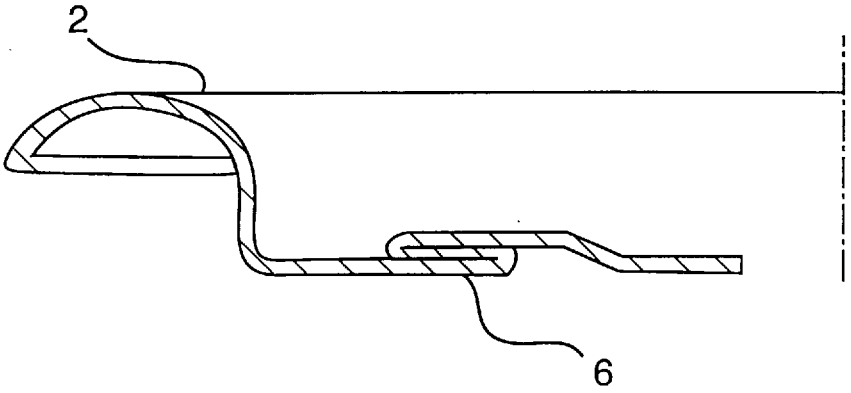
FIG. 9 shows in schematic form the easy open end of present invention.
Figure 10:
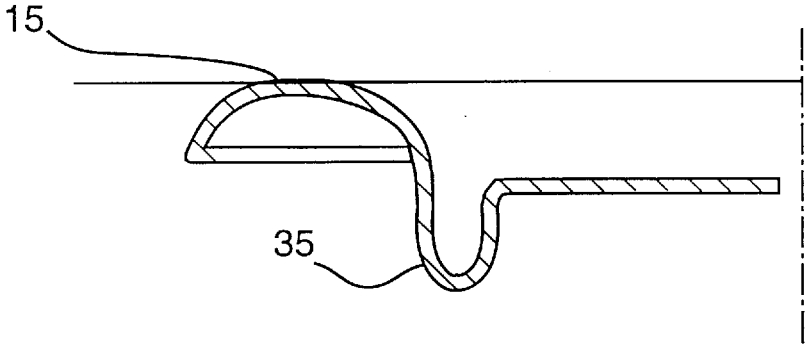
FIG. 10 BACKGROUND ART
FIG. 10 shows in schematic form an easy open end of the background art.

Another advantage of the present invention can be seen by examining the cross section of an ordinary easy open end 15 (see FIG. 10). In most cases, these ends have a downward projection bead 35, called a countersink, to reinforce the end and to prevent deformation (buckling) due to internal pressures in the can. In the present invention (see FIG. 9), the three layers of material provided by the S-shaped bend 6 will reinforce the peripheral part of the flat panel at the end 2, so that even without a countersink, the resistance to buckling will be at least equal to that of a conventional easy open end. This way proved by tests performed by the inventor. As a consequence of the above, even though the forming of protuberance 16 (FIG. 3) requires some extra material, the elimination of the countersink will save a corresponding amount of material, so that the new end will be manufactured with the same amount of material (same blank diameter) as a conventional easy open end. Therefore, the material costs for the new end will not be increased.

The invention being thus described, it will be obvious that the same may be varied in many ways. Such variations are not to be regarded as a departure from the spirit and scope of the invention, and all such modifications as would be obvious to one skilled in the art were intended to be included within the scope of the following claims.

I claim:

1. A process for forming an easy open container lid comprising the steps of:

forming a container lid blank with a continuous, semi-toroidal protuberance near a perimeter of the lid blank;

coining a scored ring between the continuous, semi-toroidal protuberance and the perimeter, and adjacent an edge of the continuous, semi-toroidal protuberance;

providing a forming press having a first die and, a second die, the first die including a first flat surface from which a pressing surface is projected perpendicularly toward the second die, a first conical surface extending from the pressing surface to a second flat surface at a same level as the first flat surface; the second die including a third flat surface located across from the first flat surface of the first die, a second conical surface extending from the third flat surface, a juncture between the third flat surface and second conical surface being located across from the pressing surface of the first die, the second conical surface corresponding to the first conical surface in both location and angle, and a fourth flat surface located across from the second flat surface; and deforming the continuous, semi-toroidal protuberance using a deforming force having a first component force directed toward the perimeter and a second component force directed transversely to the direction of the first component force, wherein the continuous, semi-toroidal protuberance is shaped into an s-shaped bend, said step of deforming comprising pressing the first die and the second die together such that pressure exerted on the continuous, semi-toroidal protuberance between the first conical surface and the second conical surface causes the deforming force having the first component force directed toward the perimeter and the second component force directed transversely to the direction of the first component force.

2. The process as set forth in claim 1, wherein said deforming step is performed in such a way that substantially no stretching of the container lid occurs, thereby a cross-sectional thickness of the s-shaped bend is approximately equal to three times a cross-sectional thickness of the continuous, semi-toroidal protuberance prior to deforming.

3. The process as set forth in claim 1, wherein an offset distance between the third flat surface and the fourth flat surface is less than or equal to twice a cross-sectional thickness of the continuous, semi-toroidal protuberance prior to deforming.

4. The process as set forth in claim 1, wherein said step of deforming further comprises:

providing a hold-down ring around a perimeter of one of the first die and the second die;

pressing the second die toward the first die;

contacting the hold-down ring with the lid blank, adjacent the perimeter of the lid blank;

continuing to press the second die toward the first die; and sliding the hold-down ring relative to the one of the first die and the second die, against a biasing force.

5. The process as set forth in claim 4, wherein the one of the first die and the second die is the second die.

* * * * *